US005853251A

United States Patent [19]

Imai

[11] Patent Number: 5,853,251

[45] Date of Patent: Dec. 29, 1998

[54] MANUAL PRINTING DEVICE

[75] Inventor: Koji Imai, Nagoya, Japan

[73] Assignee: Brother Kogyo Kabushiki Kaisha, Nagoya, Japan

[21] Appl. No.: 829,118

[22] Filed: Apr. 10, 1997

[30] Foreign Application Priority Data

Apr. 11, 1996 [JP] Japan ..... 8-115368
Apr. 19, 1996 [JP] Japan ..... 8-122286

[51] Int. Cl.[6] ..... B41J 3/36

[52] U.S. Cl. ..... 400/88; 347/109

[58] Field of Search ..... 400/88, 120 HH; 347/109, 84, 85

[56] References Cited

U.S. PATENT DOCUMENTS 3,656,169 4/1972 Kashio ..... 347/109
4,412,232 10/1983 Weber et al. ..... 347/109

FOREIGN PATENT DOCUMENTS 61-29563 2/1986 Japan ..... 400/88
63-51160 3/1988 Japan ..... 400/88
63-274554 11/1988 Japan ..... 400/88
2-263671 10/1990 Japan ..... 400/88

*Primary Examiner*—Christopher A. Bennett
*Attorney, Agent, or Firm*—McGinn & Gibb, P.C.

[57] ABSTRACT

A manual printing device manually scanned across a recording medium to record images in ink on the recording medium, the device including: a recording unit for recording images in ink on the recording medium; an ink supply unit including an ink tank filled with ink and an ink tube for supplying ink from the ink tank to the recording unit; an ink tube valve disposed along the ink tube and for controlling supply of ink from the ink tank to the recording unit; and an ink tube valve drive unit for opening the ink tube valve when the recording unit is in confrontation with the recording medium and closing the ink tube valve when no recording medium is in confrontation with the recording unit.

20 Claims, 8 Drawing Sheets

MANUAL PRINTING DEVICE

BACKGROUND OF THE INVENTION

1. Field of the Invention

The present invention relates to a printing device and more particularly to a printing device.

2. Description of the Related Art

There has been known a manual printing device for printing at a desired position on various types of recording media. The device includes a print head; an ink tank filled with ink; and a tube for supplying ink from the ink tank to the print head. The print head can be an ink jet type print head wherein printing is performed by ejecting ink onto a recording medium without contacting the recording medium. The device is connected with a host computer, from which the device receives print data for printing an image on the recording medium. In order to print using such a manual printing device, a user holds the device by hand and scans it, at an optional speed, across the surface of a recording medium. According to movement amount of the device and the print data inputted from a host computer, the print head ejects ink from the ink tank onto the recording medium. In this way, the manual printing device is capable of printing on thick or large recording media that a normal type printing device can not print on.

SUMMARY OF THE INVENTION

However, in the above-described manual printing device, supply of the ink from the ink tank is supplied through the ink tube to the print head is driven by gravity acting on the ink itself. Therefore, when the manual printing device is vibrated or shocked between printing operations, ink may leak out of the print head, thereby staining areas around the device and also wasting ink.

A manual printing device using an ink-jet type print head can print on recording media with rough surfaces, something that can not be done using a heat-transfer type printing head. In this way, using an ink-jet type print head is advantageous. However, a drawback of ink-jet type print heads is that, because ink is supplied to the print head using weight of the ink itself, ink can not be smoothly supplied and printing can not be properly performed unless the device is in a predetermined posture, that is, with the ink tank positioned above the print head.

It is an objective of the present invention to overcome the above-described problems and to provide a manual printing device wherein ink will not leak out from the device when it is vibrated or shocked during non-printing periods. It is also an objective of the present invention to provide a manual printing device capable of smoothly supplying ink to the print head so that printing can be performed on any surface of a recording medium, at any angle, and without any restriction on the posture of the device.

In order to achieve the above-described objectives, a manual printing device according to the present invention is manually scanned across a recording medium to record images in ink on the recording medium, and the device includes: a recording unit for recording images in ink on the recording medium; an ink supply unit including an ink tank filled with ink and an ink tube for supplying ink from the ink tank to the recording unit; an ink tube valve disposed along the ink tube and for controlling supply of ink from the ink tank to the recording unit; and an ink tube valve drive unit for opening the ink tube valve when the recording unit is in confrontation with the recording medium and closing the ink tube valve when no recording medium is in confrontation with the recording unit.

With this configuration, the ink tube valve drive unit drives the ink tube valve, which is disposed along the ink tube for supplying ink from the ink tank to the recording unit, to open when the recording unit is in a position confronting the recording medium and to close when the recording medium is not. Therefore, ink is not supplied to the recording unit when printing is not being performed. Therefore, ink will not leak out during non-printing periods even when the device is vibrated or shocked. As a result, areas around the device will not be stained by ink. Further, ink in the ink tank can be prevented from drying out.

According to another aspect of the present invention, the ink tube valve driving unit is linked with the ink tube valve. Also, the ink tube valve driving unit is configured from a shaft portion capable of moving in one direction by contact with the recording medium; and an urging portion for urging the shaft portion in the opposite direction. With this configuration, the ink tube valve is controlled to open or to close according to whether or not the shaft portion is in contact with the recording medium. Therefore, ink can be prevented from leaking during non-printing periods even when the device is vibrated or shocked.

According to another aspect of the present invention, a detecting unit is provided for detecting whether or not the recording medium is in a position confronting the recording unit. The ink tube valve driving unit controls the ink tube valve to open and close and according to detection by the detection unit. With this configuration, ink will not leak out during non-printing periods even when the device is vibrated or shocked. Areas around the device will remain unstained by ink.

According to another aspect of the present invention, an ink-jet type recording unit is used as the recording unit. The configuration required for an ink-jet type recording head is simpler than that required for a wire dot type recording unit using print ribbon and the like. Therefore, the device can be made smaller and printing can be performed in more vivid colors.

According to still another aspect of the present invention, a manual printing device is manually scanned across a recording medium to record images in ink on the recording medium, and the device includes: a recording unit for recording images in ink on the print medium; an ink tank filled with ink to be supplied to the recording unit; and a pressurizing unit for pressurizing ink supplied from the ink tank to the recording unit.

With this configuration, the pressurizing unit applies pressure to ink supplied from the ink container to the printing unit so that even when the printing unit is not facing downward, ink is smoothly supplied and printing can be properly performed.

According to another aspect of the present invention, the pressurizing unit includes a pump driven by drive force of the scanning unit, which rotates when a user scans the device by hand. Therefore, a separate drive source, such as a motor, need not be provided.

According to another aspect of the present invention, an adjusting unit is provided for adjusting pressure applied to the ink by the pressurizing unit. With this configuration, ink can be supplied to the printing unit at a fixed pressure.

According to another aspect of the present invention, the adjustment unit is an adjustment valve for adjusting pressure of ink applied by the pressurizing unit according to pressure applied to the ink by the pressurizing unit. With this configuration, the adjusting valve automatically adjusts pressure of ink pressurized by the pressurizing unit regardless of the posture of the device with respect to the direction of gravity. Therefore, ink pressure is adjusted to be fixed regardless of direction of the device.

BRIEF DESCRIPTION OF THE DRAWINGS

The above and other objects, features and advantages of the invention will become more apparent from reading the following description of the preferred embodiment taken in connection with the accompanying drawings in which:

FIG. 5 (*b*) is a side view showing the ink tube valve in an open condition when a lower tip of the shaft is in contact with a recording medium.

DETAILED DESCRIPTION OF THE PREFERRED EMBODIMENTS

Figure 1:
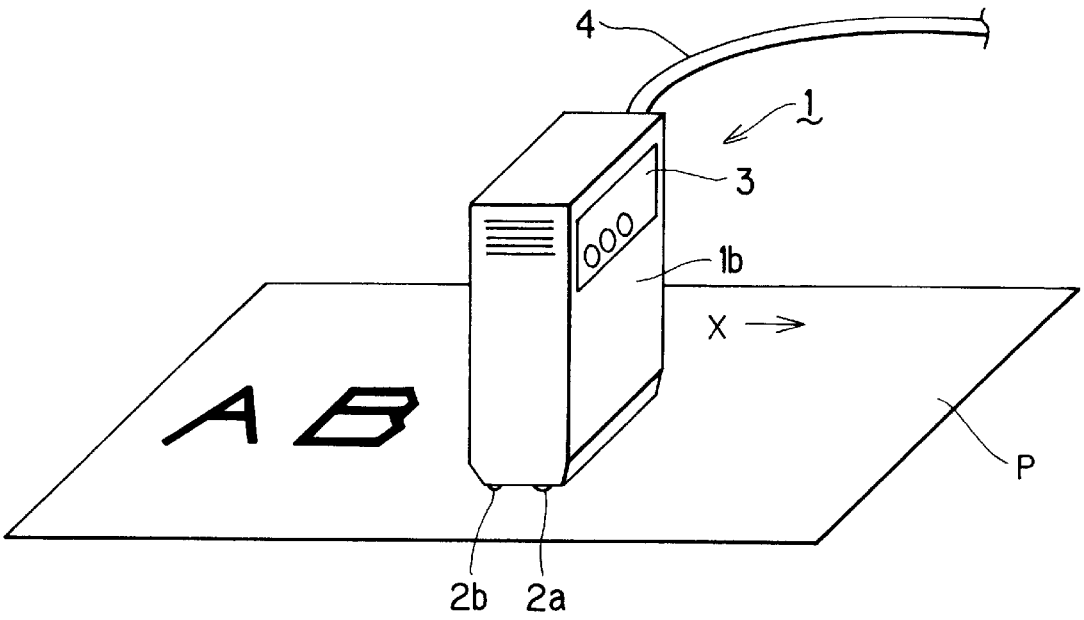
FIG. 1 is a perspective view showing a manual printing device according to a first embodiment of the present invention.

FIG. 1 is a perspective view showing a manual printing device according to a first embodiment of the present invention. A body 1*b* of a manual printing device 1 has a rectangular shape so that a user can easily hold it by hand. A front roller 2*a* and a rear roller 2*b* are rotatably provided to the lower tip of the body 1*b*. An operation panel 3 is provided to the body 1*b*. The operation panel 3 includes operation switches for turning a power source on and off and for selecting a print mode of the manual printing device 1. A cable 4 is also provided for inputting print data and the like from a host computer.

In order to print the print data inputted from the host computer onto a recording medium P, such as a recording sheet, a user grasps the body 1*b* by hand and scans it across the recording medium P in a scanning direction X, while maintaining the front roller 2*a* and the rear roller 2*b* in contact with the upper surface of the recording medium P. During printing, the front roller 2*a* and the rear roller 2*b* maintain the body 1 in an upright orientation and also maintain a fixed distance between a print head (to be described later) and the recording medium P. In a manner to be described later, the relative position, that is, movement, between the print head and the recording medium P is detected by rotation of the front roller 2*a* and the rear roller 2*b*. Printing is performed based on the detected relative position.

Figure 2:
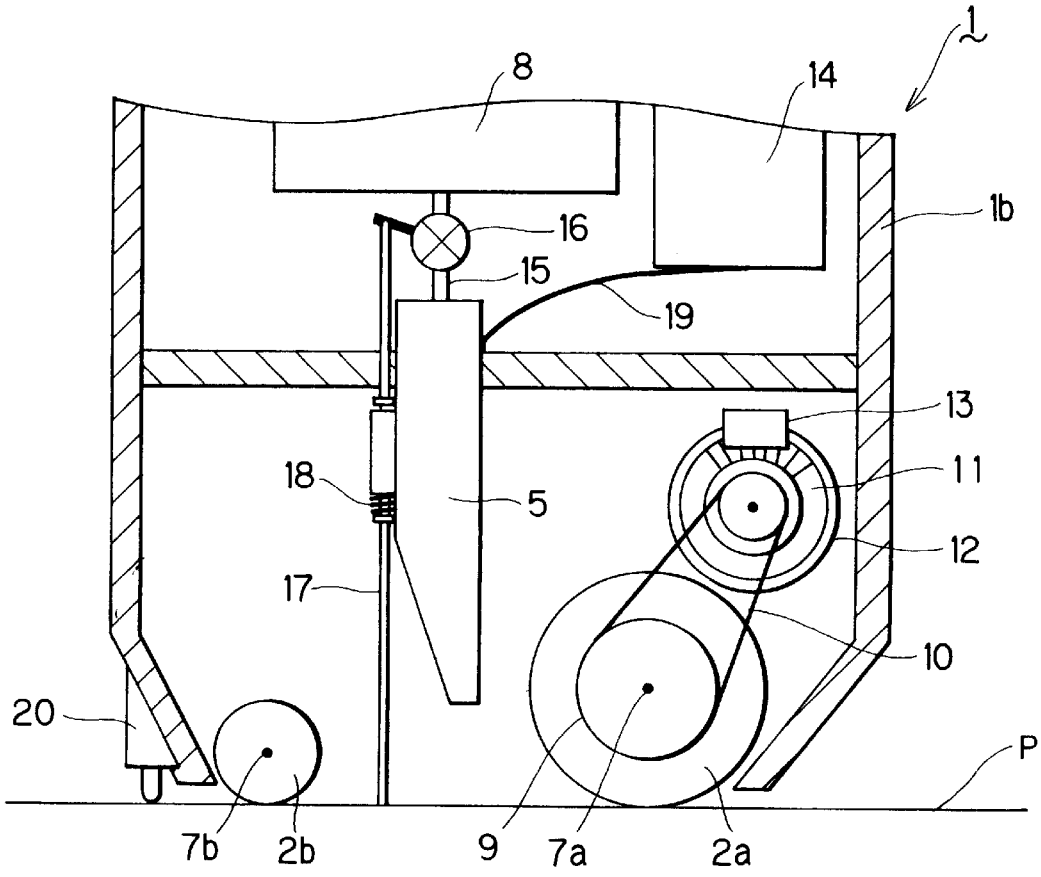
FIG. 2 is a cross-sectional view showing internal configuration of the manual printing device according to the first embodiment.

FIG. 2 is a cross-sectional view showing internal configuration of the manual printing device 1 in the vicinity of where the manual printing device 1 contacts with the recording medium P. An ink jet type print head 5 is provided as a recording unit. The front roller 2*a* and the rear roller 2*b* are freely rotatably disposed on shafts 7*a* and 7*b* respectively. A pulley 9 is fixed to the shaft 7*a* of the front roller 2*a* so as to rotate in association with rotation of the front roller 2*a*. A belt 10 is suspended between the pulley 9 and a rotation disk 12 of an encoder 11 so that rotational force generated by the pulley 9 in association with rotation of the front roller 2*a* is transmitted to the rotation disk 12 of the encoder 11.

Slits are formed in the periphery of the rotation disk 12 at a predetermined interval. When the rotation disk 12 is rotated, a photointerrupter 13 of the encoder 11 is turned on and off in accordance with locations of the slits. The photointerrupter 13 converts the rotational speed of the front roller 2*a*, which represents movement between the print head 5 and the recording medium P, into an electric pulse signal. The electric pulse signal is inputted into a control portion 14 to be described later. The photointerrupter 13 also detects rotational direction of the front roller 2*a*.

An ink tank 8 for supplying ink to the print head 5 is provided above the print head 5. An ink tube 15 for transporting ink to the print head 5 is provided between the print head 5 and the ink tank 8. An ink tube valve 16 is provided in the ink tube 15 for controlling ink supply. A vertically movable shaft 17 is linked with the ink tube valve 16 so that abutment with the recording medium P moves the shaft 17 upward, the ink tube valve 16 is opened. A spring 18 is provided for urging the shaft 17 downward so that the lower tip of the shaft 17 protrudes below the front roller 2*a* and the rear roller 2*b*.

The control portion 14 includes a CPU 21 and is provided to the side of the ink tank 8. The CPU 21 is for controlling printing by the print head 5; detection by the photointerrupter 13; and reception of print data by an interface portion (not shown in the drawings). A flexible printed circuit (FFC) 19 is provided for transmitting a print control signal from the control portion 14 to the print head 5. A detecting switch 20 for detecting whether or not the front roller 2*a* and the rear roller 2*b* are in contact with the recording medium P is disposed at the lower edge of the body 1*b*.

Figure 3:
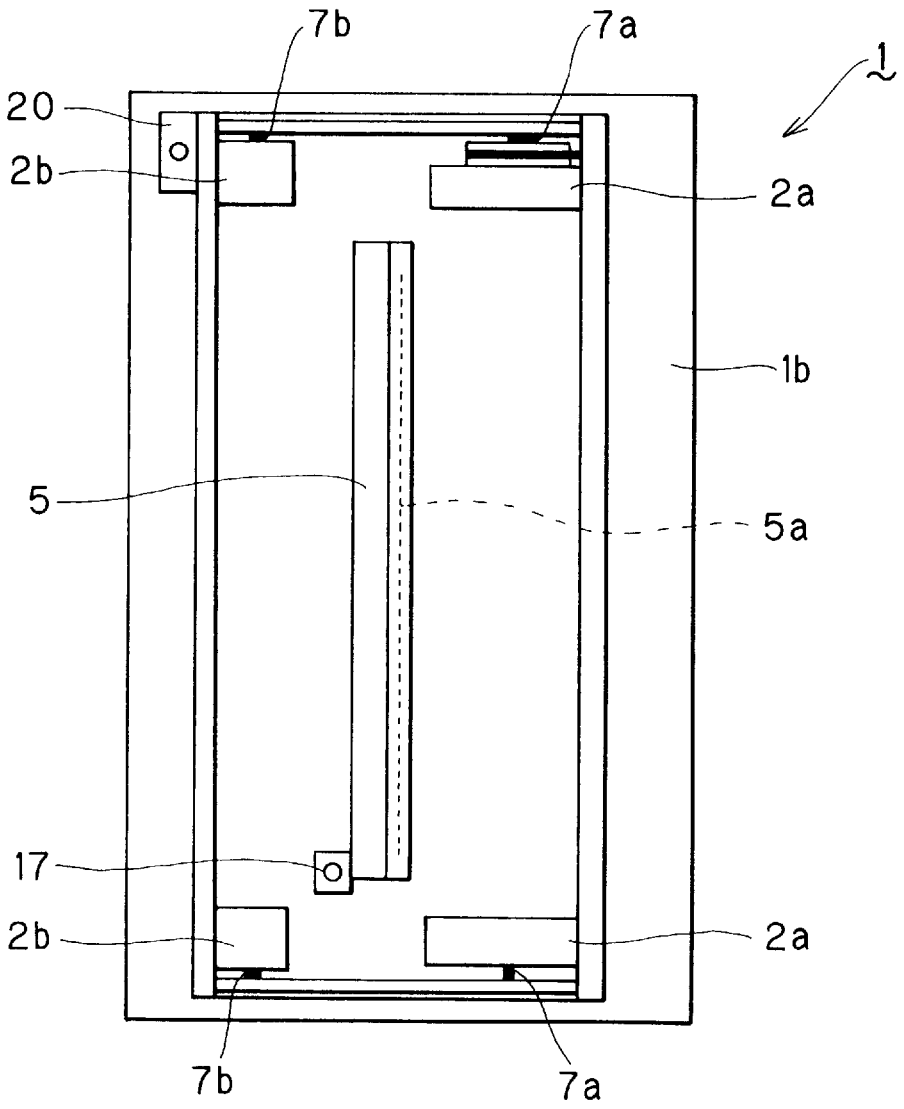
FIG. 3 is an underside view showing arrangement of a print head and surrounding components of the manual printing device according to the first embodiment.

FIG. 3 is a plan view showing the lower surface of the manual printing device 1. A plurality of nozzles 5*a* are aligned on the lower edge of the print head 5 in a row extending to a maximum printing width in a direction perpendicular to the scanning direction X. The front and rear rollers 2*a*, 2*b* are disposed on either the front and rear respectively of the print head 5 with respect to the scanning direction. Further, the front and rear rollers 2*a*, 2*b* are disposed outside of a print region printable by the row of nozzles 5*a*.

Figure 4:
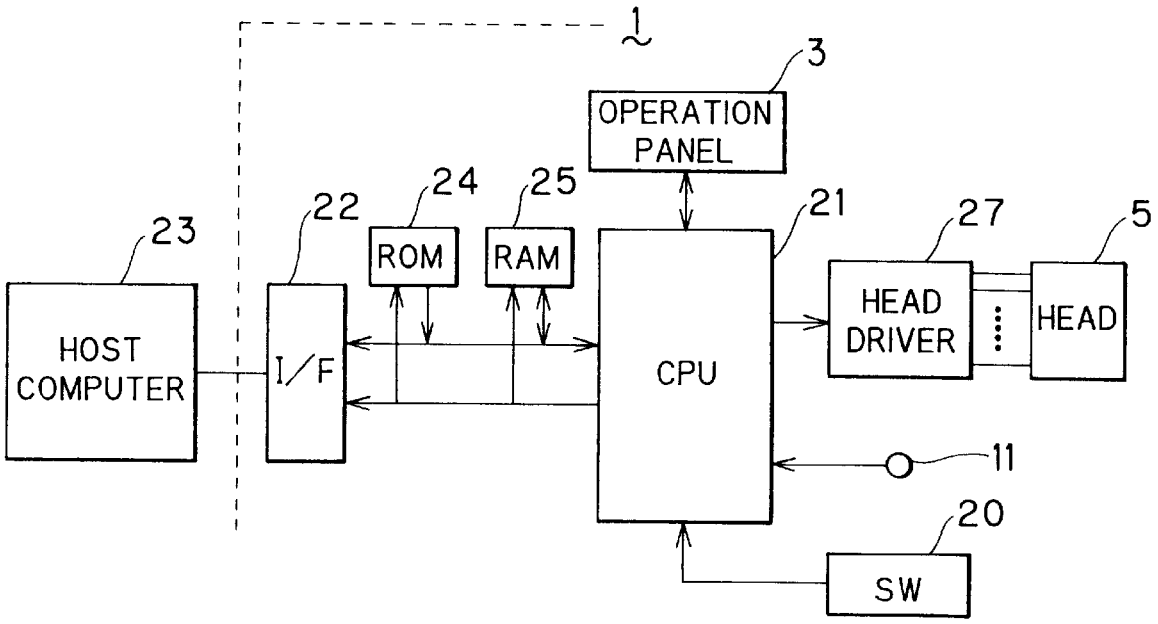
FIG. 4 is a block diagram showing a control system of the manual printing device according to the first embodiment.

FIG. 4 is a block diagram showing a control system of the manual printing device 1. The CPU 21 of the control portion 14 is for controlling overall operations of the manual printing device 1 and is connected to a host computer 23 via an interface portion 22. Also, the CPU 21 is connected to: a ROM 24 storing programs for controlling each component of the control system; a RAM 25 storing print data inputted from the host computer 23 via the interface portion 22; the operation panel 3 including the operation switches and the like; the encoder 11; and the detecting switch 20. The encoder 11 detects rotational speed and rotational direction of the front roller 2*a* and outputs a pulse signal to the CPU 21 accordingly. The detecting switch 20 outputs a detection signal to the CPU 21. Based on these signals, the CPU 21 drives the print head 5 via a head driver 27.

Next, an explanation will be provided for printing operations of the manual printing device 1 with the above-described configuration. The manual printing device 1 is operated based on a predetermined program stored in the ROM 24. When a user operates switches of the operation panel 23 to select a print mode, the CPU 21 controls input of print data from the host computer 23 through the interface portion 22 and temporally stores it in the RAM 25. When the CPU 21 receives a start print signal inputted from the operation panel 23, the CPU 21 confirms that print data is stored in the RAM 25 and then, the CPU 21 brings the manual printing device 1 into a print standby condition.

At this time, when the CPU 21 determines that the detection switch 20 is turned ON and that the rotation disk 12 is being rotated, the CPU 21 controls output of the print data in association with rotational amount of the front roller 2*a*. Printing is performed on the recording medium P by driving the print head 5 according to the amount of the outputted print data. Therefore, even if the body 1*b* is scanned across the surface of the recording medium P at a varying speed, a desired image can be printed on the recording medium P.

Figure 5A:
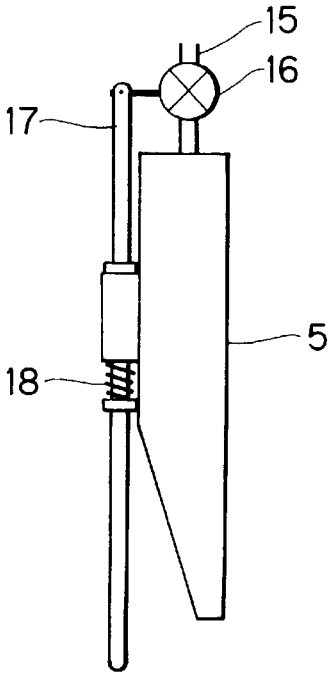
FIG. 5 (*a*) is a side view showing an ink tube valve of the manual printing device according to the first embodiment in a closed condition when a shaft connected thereto is not in contact with the recording medium.
Figure 5B:
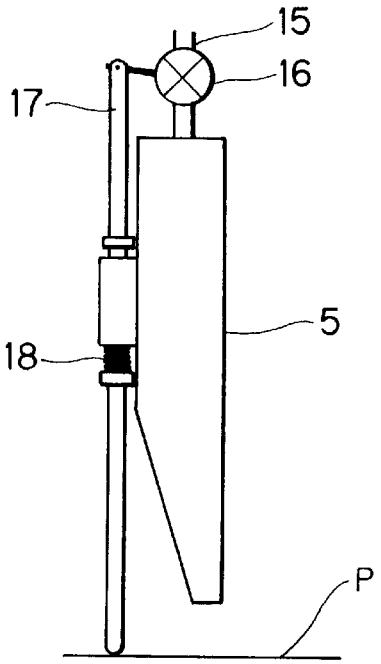

Next, while referring to FIG. 5, an explanation will be provided for controlling whether the ink tube valve 16 is opened or closed. FIGS. 5 (*a*) and 5 (*b*) are side views showing the relation between vertical position of the shaft and open and closed condition of the ink tube valve 16. FIG. 5 (*a*) is a side view showing the shaft 17 when not in contact with the recording medium P. FIG. 5 (*b*) is a side view showing the shaft 17 in contact with the recording medium P. The shaft 17 and the ink tube valve 16 are linked together so that the ink tube valve 16 is closed when the shaft 17 is in its lowermost portion as urged by the spring 18 and opened when the shaft 17 is raised upward by contact with the recording medium P. As described above, the shaft 17 is urged to protrude below the front roller 2*a*. Therefore, when the recording medium P is not in a position confronting the print head 5, the ink tube valve 16 is in a closed condition as shown in FIG. 5 (*a*).

On the other hand, when the recording medium P is in a position confronting the print head 5, the lower tip portion of the shaft 17 contacts the surface of the recording medium P and the shaft 17 is pressed upward by the recording medium P. Only in this case will the ink tube valve 16 be in its opened condition. As a result, when printing is being performed so that the print head 5 is in a position confronting the recording medium P, the ink tube valve 16 will be opened so that ink is supplied from the ink tank 8 to the print head 5. On the other hand, when printing is not being performed, that is, when the print head 5 is not in a position confronting the recording medium P, the ink tube valve 16 will be closed so that ink is not supplied from the ink tank 8 to the print head 5. Therefore, while printing is not being performed, that is, when the print head 5 is not in a position confronting the recording medium P, ink from the ink tank 8 can not leak through the print head 5.

In this way, according to the manual printing device 1 of the present embodiment, the ink tube valve 16 opens when the lower tip portion of the shaft 17 is in contact with the recording medium P so that the shaft 17 is pressed upward, and it closes when the lower tip portion of the shaft 17 is not in contact with the recording medium P. Only when the print head 5 is in a position confronting the recording medium P, that is, when printing is being performed, ink can be supplied from the ink tank 8 to the print head 5. Therefore, ink will not leak from the print head 5 even when the manual printing device 1 is vibrated or shocked, thereby preventing the ink from staining areas around the manual printing device 1.

Figure 6:
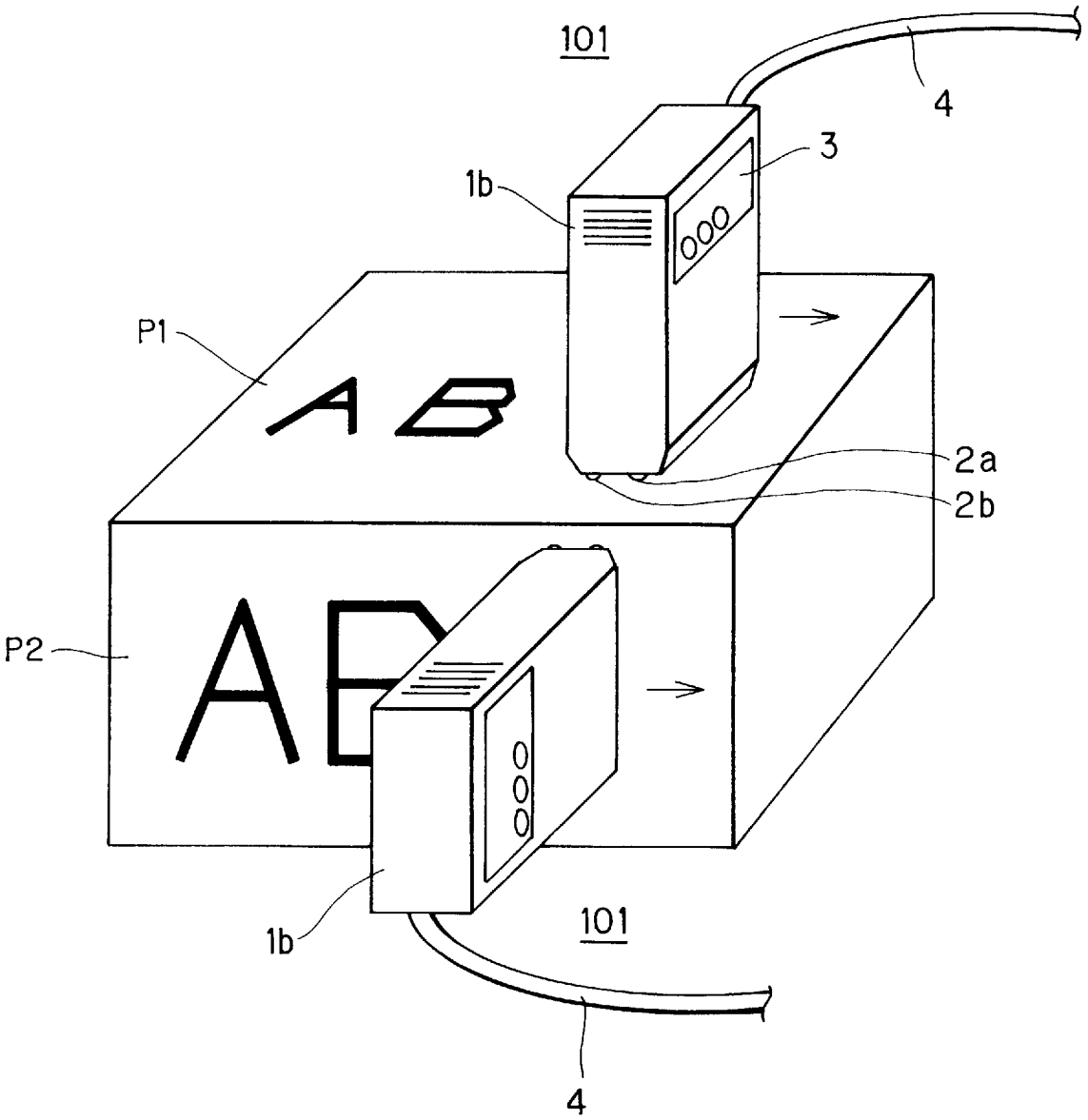
FIG. 6 is a perspective view showing a manual printing device according to a second embodiment of the present invention.

Next, a manual printing device 101 according to a second embodiment of the present invention will be described while referring to FIGS. 6 to 9 wherein like parts and components are designated by the same reference numerals as in the first embodiment to avoid duplicating description. As shown in FIG. 6, the device 101 according to the second embodiment can perform printing operations on wall sides P1 and P2 of a print medium while disposed at any angle.

Figure 7:
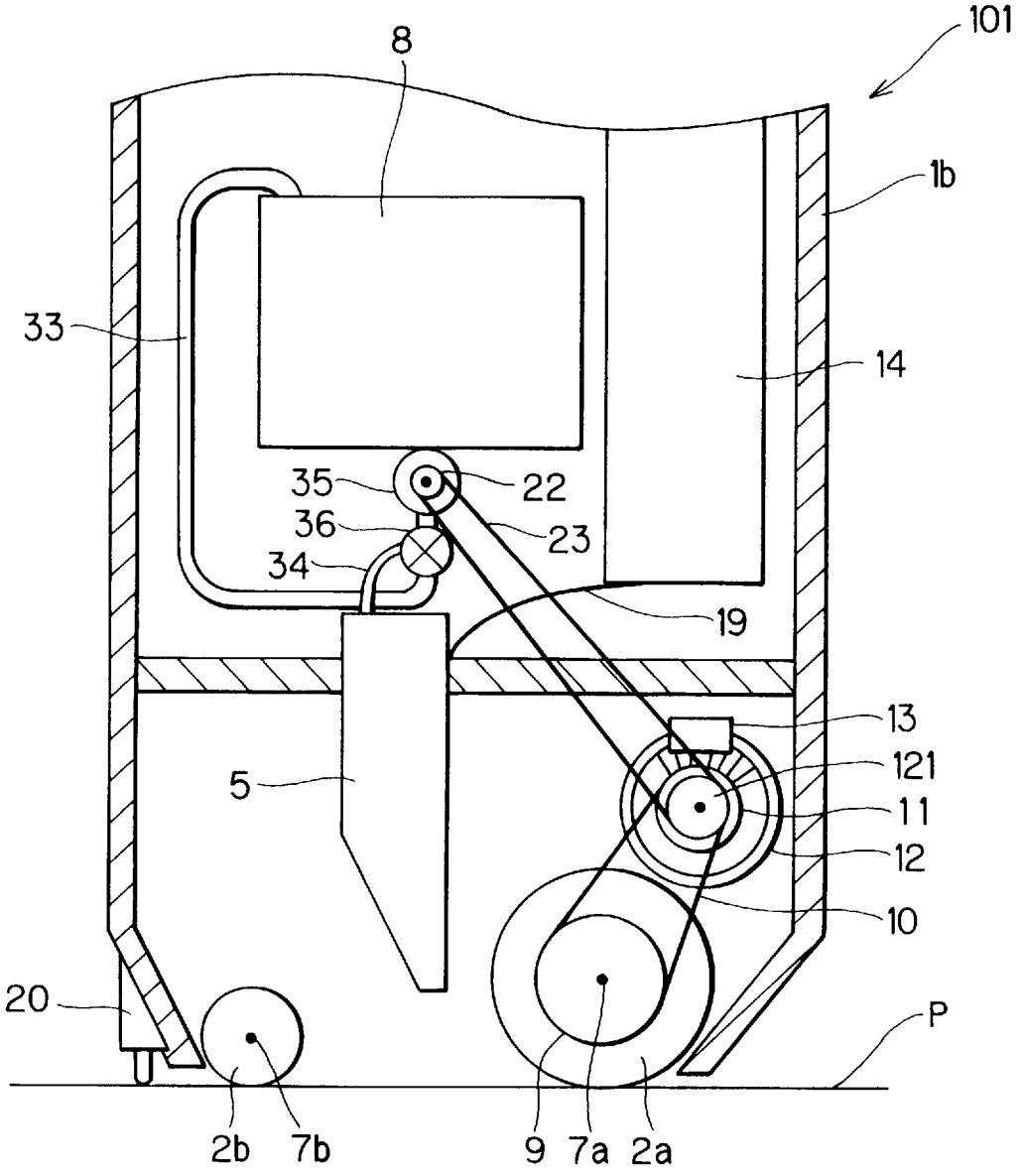
FIG. 7 is a cross-sectional view showing internal configuration of the manual printing device according to the second embodiment.
Figure 8:
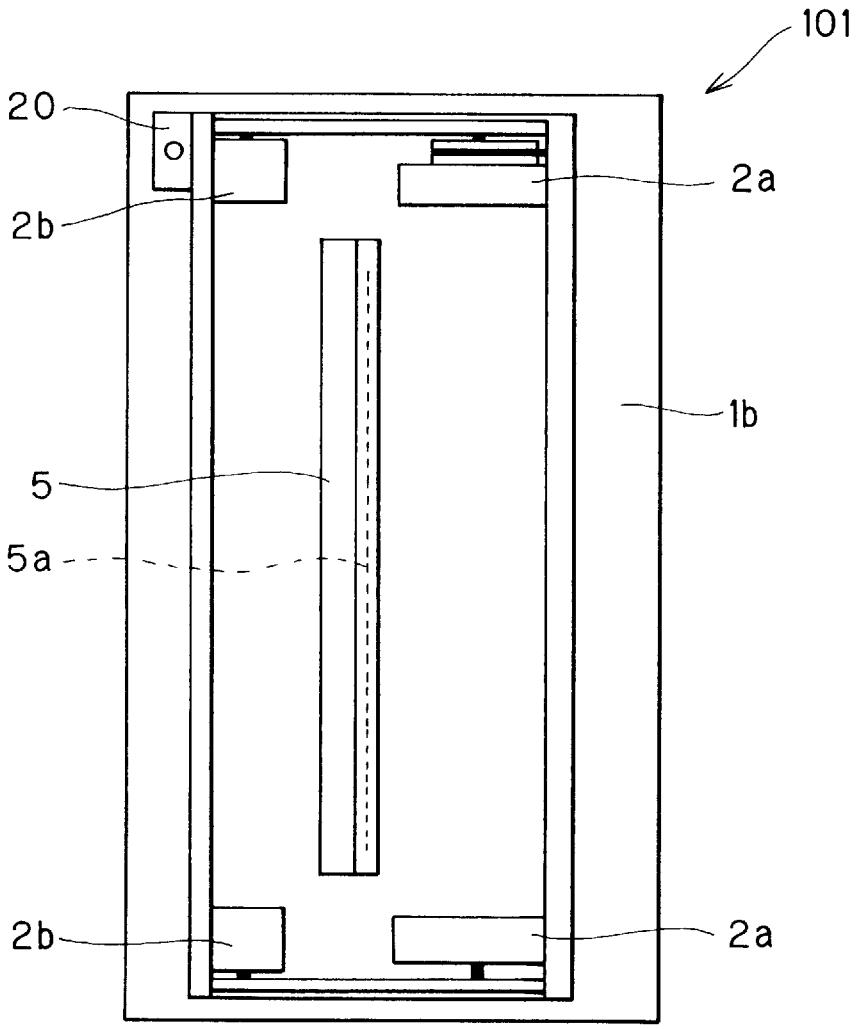
FIG. 8 is an underside view showing arrangement of a print head and surrounding components of the manual printing device according to the second embodiment.

As shown in FIG. 7, a pump 35 for pressurizing ink and an adjusting valve 36 for adjusting pressure applied to the ink by the pump 35 are provided between the ink tank 8 and the print head 5. The pump 35 and the adjusting valve 36 are connected by a pipe-shaped supply tube 34 for supplying ink from the ink tank 8 to the print head 5. Surplus ink prevented from flowing to the print head 5 by the adjusting valve 36 is returned to the ink tank 8 via a circulation tube 33. The pump 35 has a drive shaft 22. A pulley 121 is attached to the same shaft as the rotation disk 12. A belt 23 is suspended between the pulley 121 and the drive shaft 22 of the pump 35. With this configuration, when a user, in order to perform printing, scans the device 101 across the recording medium P so that the front rollers 2*a*, shown in FIG. 7, rotate across the surface of the recording medium P, then, as a result, the pump 35 is driven by drive force generated by rotation of the front roller 2*a*. The adjusting valve 36 adjusts ink pressure of ink supplied to the print head 5, regardless of posture of the device 101 with respect to the direction of gravity.

Figure 9:
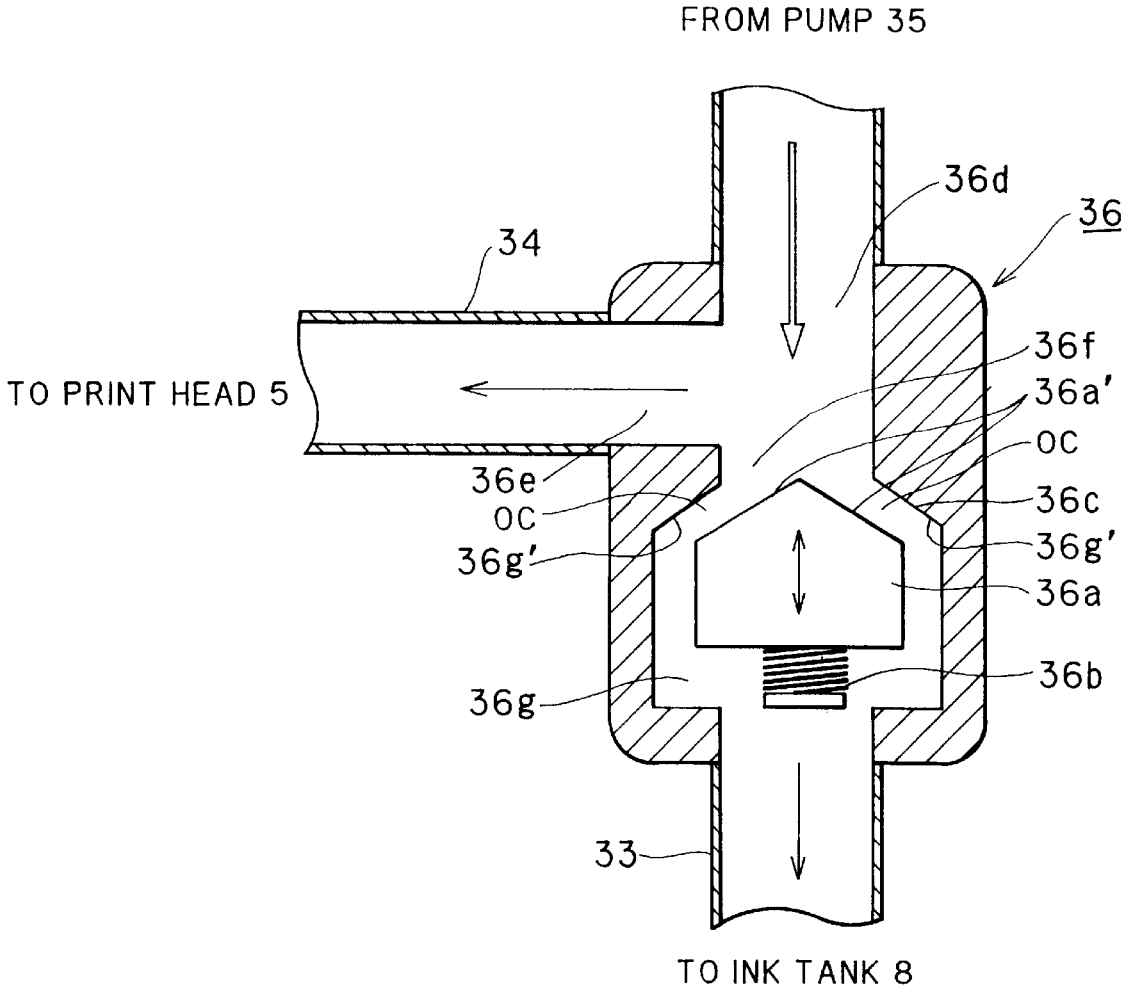
FIG. 9 is a cross-sectional view showing an adjusting valve portion of the manual printing device according to the second embodiment.

FIG. 9 is a cross-sectional view showing detailed configuration of the adjusting valve 36. The adjusting valve 36 includes: a valve housing 36*c*, a valve body 36*a*, and a spring 36*b*. The valve housing is formed with a pump port 36*d* connected to the pump 36; a print head port 36*e* connected to the supply tube 34; an ink tank port 36*f* confronting the pump port 36*d*; and a valve body chamber 36*g* housing the valve body 36*a* and connected to ink tank port 36*f* at one end and to the circulation tube 33 at the other. The valve body chamber 36*g* has slanted sides 36*g*' at its side nearest the ink tank port 36*f*.

The valve body 36*a* has edges 36*a*' at its side confronting the ink tank port 36*f*. The edges 36*a*' are provided in a slanting configuration conforming to the slanted sides 36*g*' of the valve body chamber 36*g* so that overflow channels OC are formed between the edges 36*a*' and the slanted sides 36*g*' of the valve body chamber 36*g*.

The spring 36*b* is a compression spring disposed to one side of the valve body 36*a*. The spring 36*b* urges the valve body 36*a* toward the slanted sides 36*a*', that is, opposite the direction of flow of ink from the pump 35.

Because the spring 36*b* urges the valve body 36*a* in a direction opposite the direction in which ink flows from the pump 35, the edges 36*a*' of the valve body 36*a* will move away from and toward the slanted sides 36*g*' of the valve chamber 36*g* according to pressure of ink flowing from the pump 35. That is, when the device 101 is scanned rapidly so that the pump 35 applies a high pressure to the ink, the high flow of ink from the pump 35 will move the valve body 36*a* into the valve body chamber 36*g* so that the edges 36*a*' move away from the slanted sides 36*a*' and the overflow channels OC are opened wide. On the other hand, when the pump 35 applies a low pressure to the ink, the flow of ink from the pump 35 will move the valve body 36*a* only slightly into the valve body chamber 36*g*. Said differently, the greater the pressure from the pump 35, the larger the overflow channels OC will be opened, and the more ink will flow through the overflow tubes OC to the ink tank 8. Therefore, ink with a fixed pressure appropriate for the orientation of the printing device 101 is supplied to the print head 5 regardless of pressure applied by the pump 35. The adjusting valve 36 is configured so that the overflow channels OC can not be closed completely. If the overflow channesl OC were to close completely, all the ink from the pump 35 would flow to the print head 5, which would leak ink as a result.

In a manner similar to that described in the first embodiment, when the user turns ON the switch 20, the manual printing device 101 is put into a standby condition. When the user places the manual printing device 101 on the recording medium P and scans the device 101 over the recording medium P, the rotation disk 12 of the encoder 11 is rotated in association with rotation of the front roller 2*a*. Print data is controlled to be outputted according to rotational amount of the front roller 2*a*. The print head 5 is driven according to the print data so that printing is performed on the recording medium P. Output of printing data is controlled in association with rotational amount of the front roller 2*a* so that a predetermined image can be printed on the recording medium P even when scanning speed of the body 1*b* on the recording medium P is not uniform.

When the front roller 2*a* is rotated as described above, the pump 35 is driven by rotational force of the front roller 2*a*. In this way, ink from the ink tank 8 is applied with pressure by the pump 35 and supplied to the print head 5 after being adjusted to a fixed desired pressure by the adjusting valve 36. Therefore, printing can be stably performed regardless of the posture or orientation of the device 101, and so, as shown in FIG. 6, printing can be performed on any surface of recording medium and at any angle. Also, it is desirable to fill the ink tank 8 with an ink-impregnated foam.

An explanation will be provided for effects achieved by the configuration of the second embodiment. Conventionally, in an ink-jet type printing device, ink is supplied using pressure produced by weight (e.g., gravity) of the ink. Therefore, in order to perform printing, the device must be maintained in a posture wherein the print head is lower than the ink tank. With the conventional configuration, printing is difficult to perform when the device is in any other posture. However, no such restriction is placed on the device of the present embodiment. Further, in the present embodiment, because the pump 35 for pressurizing ink is driven by force generated when a user scans the device, a separate drive source, such as a motor, need not be provided so that manufacturing costs can be reduced.

Next, a manual printing device 201 according to a third embodiment of the present invention will be described while referring to FIG. 10. Again similar components are provided with the same numbering to avoid duplication of description.

Figure 10:
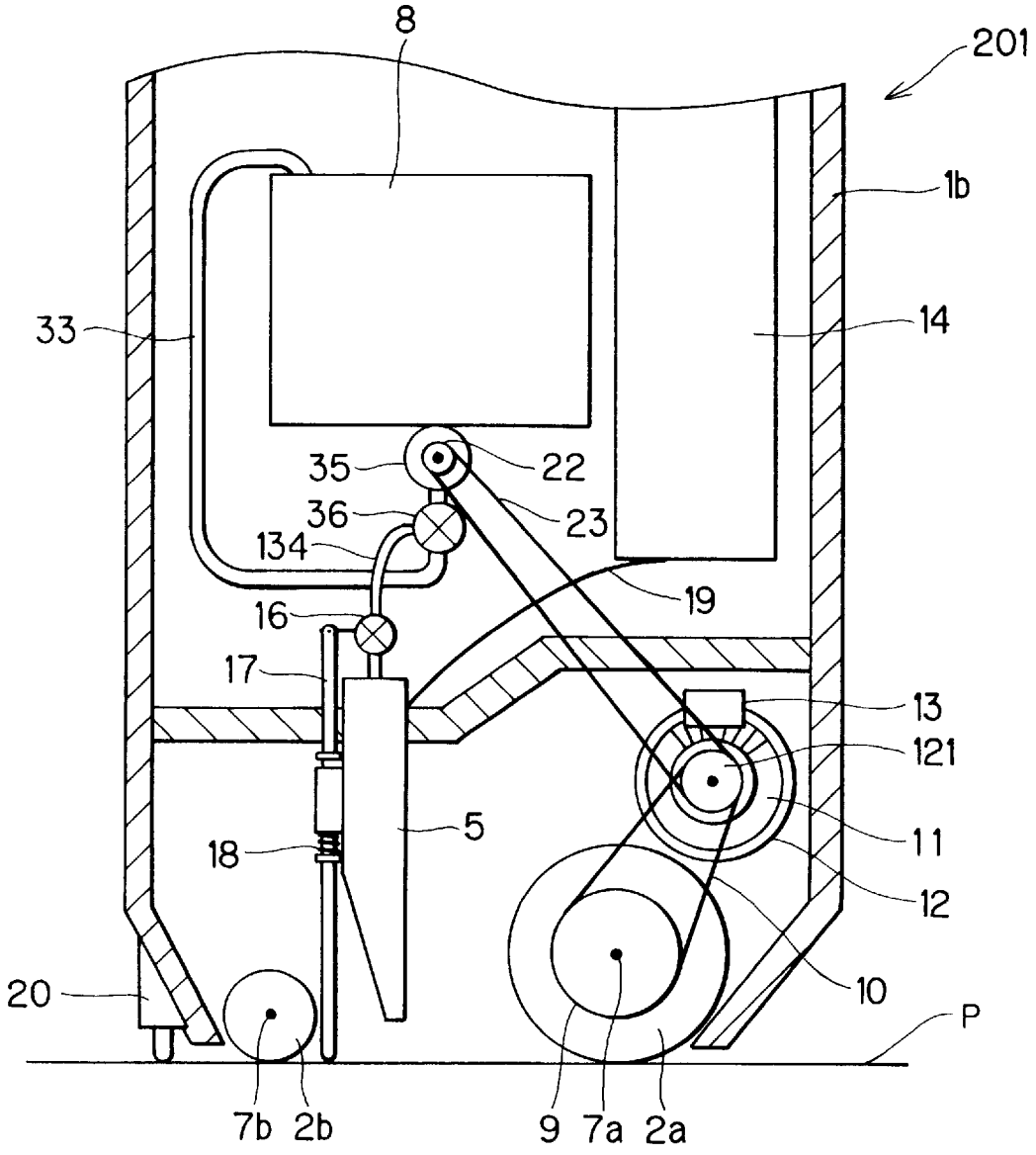
FIG. 10 is a cross-sectional view showing internal configuration of a manual printing device according to a third embodiment of the present invention.

As shown in FIG. 10, the manual printing device 201 includes the ink tube valve 16, the shaft 17, and the spring 18 described in the first embodiment, as well as the pump 35 and adjusting valve 36 described in the second embodiment. However, in the third embodiment, the print head port 36*e* of the adjusting valve 36 is connected to the ink tube valve 16 by a connection tube 134. With this configuration, the beneficial effects of both the first embodiment and the second embodiment can be achieved.

While the invention has been described in detail with reference to specific embodiments thereof, it would be apparent to those skilled in the art that various changes and modifications may be made therein without departing from the spirit of the invention, the scope of which is defined by the attached claims.

For example, in the first embodiment, the ink tube valve 16 closes when the shaft 17 is moved downward by urging of the spring 18 and opens when pressed up by the recording medium P. However, in place of the shaft 17 and the spring 18, a valve opening/closing mechanism controlled by the CPU 21 can be provided. In this case, the ink tube valve 16 can be opened or closed according to commands from the CPU 21 when the detection switch 20 detects the recording medium P.

In the second embodiment, the pump 35 is disposed at the supplying tube 34 for pressurizing ink. However, pressure can be applied directly to the ink tank 8. Also, the pump 35 can be driven by a motor and the like.

Also, in the above-described embodiments, an ink-jet type print head is used in the manual printing device 1. However, the present invention is not necessarily limited to use with an ink-jet type print head. Other printing units can be used instead.

Although tubes, such as the ink tube 15, the circulation tube, and the supply tube 34, for transporting ink are shown in the drawings as being pipe-shaped members, the word tube, when applied to the present invention, should be interpreted to include any type of tube or passage capable of transporting liquid ink.

What is claimed is:

1. A manual printing device manually scanned across a recording medium to record images in ink on the recording medium, the device comprising:

a recording unit for recording images in ink on the print medium;

an ink supply unit including an ink tank filled with ink and an ink tube for supplying ink from the ink tank to the recording unit:

an ink tube valve disposed along the ink tube and for controlling supply of ink from the ink tank to the recording unit; and an ink tube valve drive unit opening the ink tube valve in response to the recording unit being brought into confrontation with the recording medium and closing the ink tube valve when no recording medium is in confrontation with the recording unit.

2. A manual printing device as claimed in claim 1, further comprising a detection unit for detecting whether the recording unit is in confrontation with the recording medium, the ink tube valve drive unit opening the ink tube valve when the detection unit detects the recording unit is in confrontation with the recording medium, and closing the ink tube valve when the detection unit detects the recording unit is not in confrontation with the recording medium.

3. A manual printing device as claimed in claim 1, wherein the recording unit comprises an ink jet print head.

4. A manual printing device as claimed in claim 1, further comprising a pressurizing unit for pressurizing ink supplied from the ink tank to the recording unit.

5. A manual printing device, manually scanned across a recording medium to record images in ink on the recording medium, the device comprising:

a recording unit for recording images in ink on the recording medium;

an ink supply unit including an ink tank filled with ink and an ink tube for supplying ink from the ink tank to the recording unit;

an ink tube valve disposed along the ink tube and for controlling supply of ink from the ink tank to the recording unit; and an ink tube valve drive unit for opening the ink tube valve when the recording unit is in confrontation with the recording medium and for closing the ink tube valve when no recording medium is in confrontation with the recording unit, wherein the ink tube valve drive unit includes:

a shaft portion moveable in a first direction and a second direction opposite the first direction, the shaft portion being physically linked with the ink tube valve so that the ink tube valve opens when the shaft portion is moved in the first directions and closed when the shaft portion is moved in the second direction, the shaft portion being moved in the first direction by abutment against the recording medium; and an urging unit for urging the shaft portion in the second direction.

6. A manual printing device manually scanned across a recording medium to record images in ink on the recording medium, the device comprising:

a recording unit for recording images in ink on the recording medium;

an ink supply unit including an ink tank filled with ink and an ink tube for supplying ink from the ink tank to the recording unit;

an ink tube valve disposed along the ink tube and for controlling supply of ink from the ink tank to the recording unit;

an ink tube valve drive unit for opening the ink tube valve when the recording unit is in confrontation with the recording medium, and for closing the ink tube valve when no recording medium is in confrontation with the recording unit; and a pressurizing unit for pressurizing ink supplied from the ink tank to the recording unit;

wherein the pressurizing unit includes a pump provided along the ink tube.

7. A manual printing device as claimed in claim 6, further comprising a scanning unit for rotating across the recording medium in association with manual scanning of the manual printing device across the recording medium, the scanning unit also supplying a drive force to the pump.

8. A manual printing device as claimed in claim 7, further comprising an adjustment unit provided along the ink tube and for adjusting pressure applied to ink by the pressurizing unit.

9. A manual printing device as claimed in claim 8, wherein the adjustment unit includes an adjustment valve for self adjusting pressure applied to the ink by the pressurizing unit in accordance with pressure of ink supplied from the pump.

10. A manual printing device as claimed in claim 9, wherein the adjustment unit is provided downstream from the pump, the adjustment unit including:

an inlet from the pump;

an outlet to the recording unit;

an outlet to said ink tank;

a valve body disposed in the ink tube for regulating flow through the outlet to the recording unit by moving into and out of the outlet to the ink tank; and urging means for urging the valve body into the outlet to the ink tank against flow of ink from the pump.

11. A manual printing device as claimed in claim 8, wherein the ink tube valve drive unit includes:

a shaft portion moveable in a first direction and a second direction opposite the first direction, the shaft portion being physically linked with the ink tube valve so that the ink tube valve opens when the shaft portion is moved in the first direction, and closes when the shaft portion is moved in the second direction, the shaft portion being moved in the first direction by abutment against the recording medium; and an urging unit for urging the shaft portion in the second direction.

12. A manual printing device manually scanned across a recording medium to record images in ink on the recording medium, the device comprising:

a recording unit for recording images in ink on the recording medium;

an ink tank filled with ink to be supplied to the recording unit;

a pressurizing unit for pressurizing ink supplied from the ink tank to the recording unit; and an ink tube through which ink is supplied from the ink tank to the recording unit, the pressurizing unit being provided along the ink tube.

13. A manual printing device as claimed in claim 12, wherein the recording unit comprises an ink jet print head.

14. A manual printing device as claimed in claim 12, further comprising a scanning unit for rotating across the recording medium in association with manual scanning of the manual printing device across the recording medium, the scanning unit also supplying a drive force to the pressurizing unit, said pressurizing unit comprising a pump.

15. A manual printing device as claimed in claim 14, further comprising an adjustment unit provided along the ink tube and for adjusting pressure applied to the ink by the pressurizing unit.

16. A manual printing device as claimed in claim 15, wherein the adjustment unit includes an adjustment valve for self adjusting pressure applied to the ink by the pressurizing unit in accordance with pressure of ink supplied from the pump.

17. A manual printing device as claimed in claim 16, wherein the adjustment unit is provided downstream from the pump, the adjustment unit including:

an inlet from the pump;

an outlet to the recording unit;

an outlet to said ink tank;

a valve body, disposed in the ink tube, for regulating flow through the outlet to the recording unit by moving into and out of the outlet to the ink tank; and urging means for urging the valve body into the outlet to the ink tank against flow of ink from the pump.

18. A manual printing device as claimed in claim 1, further comprising a frame housing the recording unit, the ink supply unit, and the ink tube valve, the frame being manually scanned across a recording medium during recording of images, the ink tube valve drive unit opening the ink tube valve in response to the recording unit being brought into confrontation with the recording medium regardless of a movement condition of the frame.

19. A manual printing device manually scanned across a recording medium to record images in ink on the recording medium, the device comprising:

a recording unit for recording images in ink on the recording medium;

an ink tank filled with ink to be supplied to the recording unit;

a pressurizing unit for pressurizing ink supplied from the ink tank to the recording unit; and a scanning unit for rotating across the recording medium in association with manual scanning of the manual printing device across the recording medium and supplying a drive force to the pressurizing unit.

20. A manual printing device manually scanned across a recording medium to record images in ink on the recording medium, the device comprising:

a recording unit for recording images in ink on the recording medium;

an ink tank filled with ink to be supplied to the recording unit;

a pressurizing unit for pressurizing ink supplied from the ink tank to the recording unit;

an ink tube through which ink is supplied from the ink tank to the recording unit; and an adjustment unit provided along the ink tube and for adjusting pressure applied to ink by the pressurizing unit.

* * * * *